US006638007B2

(12) United States Patent
Bartholomä et al.

(10) Patent No.: US 6,638,007 B2
(45) Date of Patent: Oct. 28, 2003

(54) TURBOMACHINE WITH RADIAL-FLOW COMPRESSOR IMPELLER

(75) Inventors: Klaus Bartholomä, Landsberg/Lech (DE); Wolfgang Schmidt, Augsburg (DE)

(73) Assignee: Man B&W Diesel Aktiengesellschaft, Augsburg (DE)

( * ) Notice: Subject to any disclaimer, the term of this patent is extended or adjusted under 35 U.S.C. 154(b) by 45 days.

(21) Appl. No.: 10/072,585

(22) Filed: Feb. 6, 2002

(65) Prior Publication Data

US 2002/0114693 A1 Aug. 22, 2002

(30) Foreign Application Priority Data

Feb. 20, 2001 (DE) ..... 101 07 807

(51) Int. Cl.[7] ..... F01B 25/16

(52) U.S. Cl. ..... 415/9; 415/173.4; 415/196; 415/206; 60/39.091

(58) Field of Search ..... 415/196, 204, 415/206, 9, 220, 185, 170.1, 173.1, 173.4

(56) References Cited

U.S. PATENT DOCUMENTS

| | | | | |
|---|---|---|---|---|
| 5,271,220 A | * | 12/1993 | Holmes et al. | 60/39.091 |
| 5,934,868 A | | 8/1999 | Bättig et al. | 415/9 |
| 6,224,321 B1 | * | 5/2001 | Ebden et al. | 415/9 |
| 6,464,454 B1 | * | 10/2002 | Kotkaniemi | 415/121.1 |

FOREIGN PATENT DOCUMENTS

| | | | |
|---|---|---|---|
| DE | 37 38 929 | 5/1989 | |
| DE | 42 23 496 | 1/1994 | F16P/7/00 |
| DE | 195 02 808 | 2/1997 | |
| DE | 197 27 139 | 1/1999 | F04D/29/66 |
| EP | 0 834 646 | 4/1998 | F01D/21/04 |

* cited by examiner

*Primary Examiner*—Edward K. Look
*Assistant Examiner*—Dwayne J. White
(74) *Attorney, Agent, or Firm*—Cohen, Pontani, Lieberman & Pavane

(57) ABSTRACT

A compressor casing with a volute-shaped flow duct is fastened by means of a rigid fixing arrangement to the bearing casing of the turbomachine, with simple and low-cost means in such a way that the emergence of fragments of a burst compressor impeller from the compressor casing can be prevented. The compressor casing has an outer spiral casing, which surrounds a duct section of the flow duct deflected towards the outside into the radial direction (B), and an inner casing insert piece, which is provided in the radial direction (B) between the spiral casing and the compressor impeller and whose inner contour, together with the outer contour of the hub of the compressor impeller, forms the duct section of the flow duct extending essentially in the axial direction (A). The spiral casing is configured with an inner cylinder at least partially surrounding the casing insert piece, on which inner cylinder the casing insert piece is attached by means of a fixing arrangement, which is flexible in the axial direction (A), to form a hollow space. The flexible fixing arrangement of the casing insert is less secure against fracture than the rigid fixing arrangement of the compressor casing on the bearing casing.

6 Claims, 1 Drawing Sheet

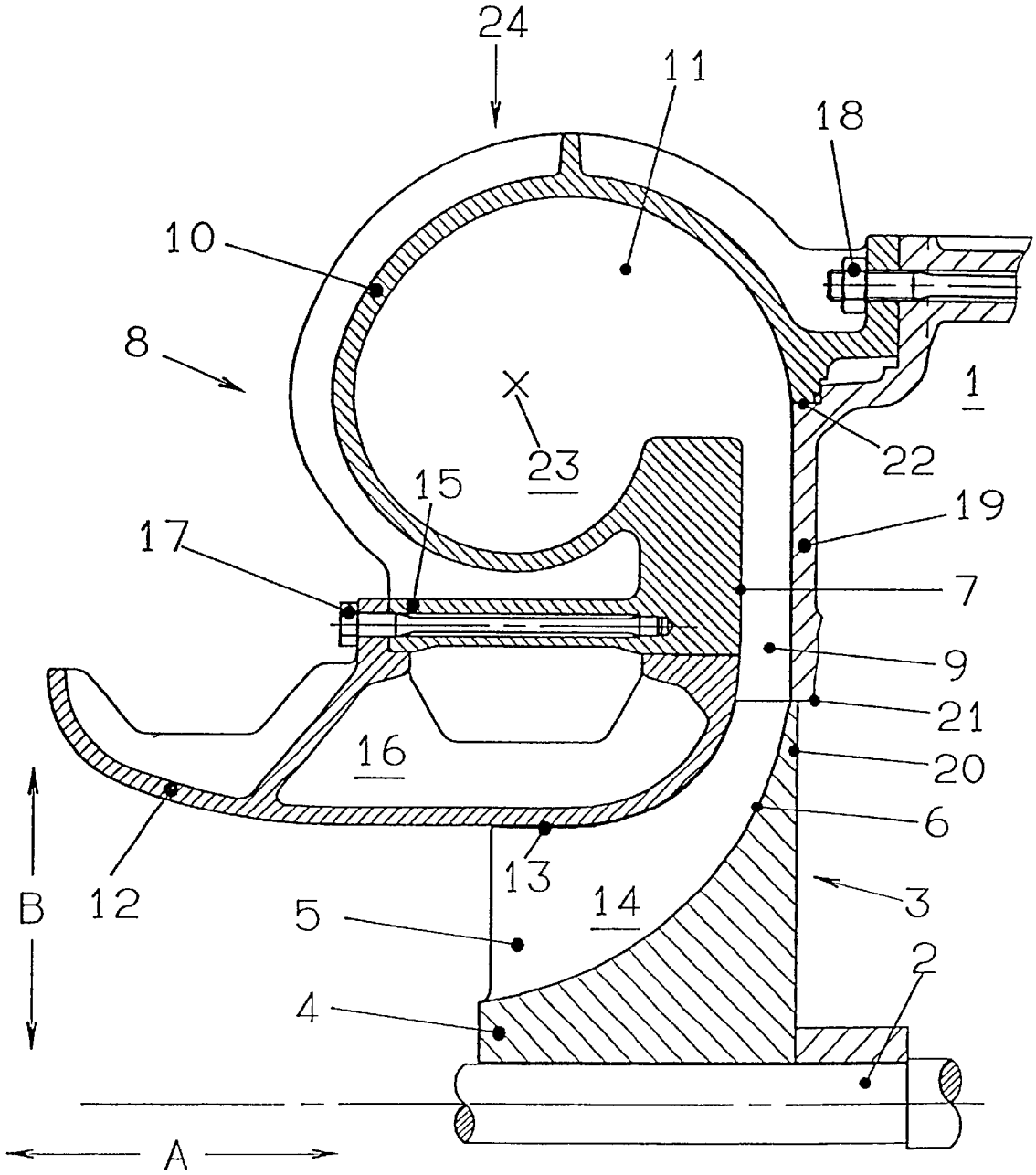
24
11
18
10
8
X
23
1
22
15
19
17
7
9
21
16
20
6
13
B
12
5
14
3
2
4
A

TURBOMACHINE WITH RADIAL-FLOW COMPRESSOR IMPELLER

BACKGROUND OF THE INVENTION

1. Field of the Invention

The invention relates to a turbomachine with radial-flow compressor impeller, which is enclosed by a spiral-shaped compressor casing with a volute-shaped flow duct having an essentially axially deflecting section and an essentially radially deflecting section. The casing includes an outer spiral casing, which includes the radially deflecting section and is rigidly fixed to the bearing casing, and an inner casing insert piece having an inner contour which with the outer contour of the hub forms the axially deflecting section.

2. Description of the Related Art

The fundamental construction and the mode of operation of such turbomachines, such for example as a centrifugal compressor of a turbocharger, are known per se and therefore require no more detailed explanation in the present connection. Thus, for example, DE 195 02 808 C2 describes a generic turbomachine in the form of a centrifugal compressor of a turbocharger, within whose spiral-shaped compressor casing the diameter of the hub of the compressor impeller and of the vanes increases in the flow direction. The outer contour of the vanes is curved and corresponds to the inner contour of the adjacent, toroidal outwardly curved duct wall of the volute-shaped flow duct. The duct wall of the compressor casing, together with the outer contour of the hub of the compressor impeller, bounds an outwardly deflected duct section, in which the vanes engage. An annular duct section opening into a spiral duct abuts this radially outwardly deflected duct section.

Such compressor casings of turbochargers, and their inserts, are usually of rigid configuration.

After lengthy operation under unfavorable conditions, such a compressor impeller can be so greatly weakened by corrosion, erosion and aging that fracture of the compressor impeller cannot be excluded. In the event of a compressor impeller fracture, in which the impeller usually breaks into two or three large fragments, these individual parts are thrown outwards due to the substantial centrifugal forces. Fragments can then even emerge from the compressor casing. In the process, the compressor impeller vanes are completely destroyed and the remaining hub body jams between the bearing casing and the compressor casing. Due to the shaping of the hub pieces, a wedge effect then occurs, which hub pieces exert substantial impulse-type axial forces on the casing.

Smaller turbochargers can absorb these forces due to the relatively large wall thicknesses and the stiff casing parts. In the case of large turbochargers, the casing wall thicknesses are usually reduced for technical casting reasons so that, in the case of such loads, the fracture limit of the material is rapidly reached and casing fractures can occur. Fragments can then emerge from the turbocharger, with substantial consequential damage.

This is to be avoided at all costs. For this purpose, it is now usual to provide an additional burst protection arrangement outside the compressor casing which accommodates the compressor impeller.

SUMMARY OF THE INVENTION

On this basis, therefore, the object of the present invention is to so develop a turbomachine of the type mentioned at the beginning, using simple and low-cost means, that the emergence of fragments of a burst compressor impeller from the compressor casing can be avoided, without having to provide an additional burst protection arrangement outside the spiral casing.

According to the invention, the outer spiral casing includes an inner cylinder to which the inner casing piece is fixed by means of a fixing arrangement to form a hollow space between the inner cylinder and the insert piece. The fixing arrangement is axially flexible and is less secure against fracture than the rigid fixing of the outer spiral casing to the bearing casing.

Because the compressor casing has an outer spiral casing, which comprises the flow duct section, which is deflected outwards into the radial direction, and an inner casing insert piece, which is provided in the radial direction between the spiral casing and the compressor impeller and whose inner contour, together with the outer contour of the hub of the compressor impeller, forms the flow duct section, which extends essentially in the axial direction, because the spiral casing is configured with an inner cylinder at least partially surrounding the casing insert piece. The casing insert piece is attached on the inner cylinder by means of a fixing arrangement, which is flexible in the axial direction, to form a hollow space, and because the flexible fixing arrangement of the casing insert is configured to be less secure against fracture than the rigid fixing arrangement of the compressor casing on the bearing casing, a spiral casing is configured with a "crumple zone", from which no fragment of a burst impeller can now emerge. The kinetic energy of fragments of a bursting compressor impeller can now be completely converted into deformation energy and heat within the turbocharger.

The rigid fixing arrangement of the spiral casing on the bearing casing, and the casing insert piece itself, can absorb considerably more kinetic energy than the flexible fixing arrangement of the casing insert piece on the spiral casing. This ensures that the casing insert piece can, in an emergency, move away from the compressor impeller in the axial direction. In this way, the kinetic energy of the compressor impeller pieces can be largely absorbed by conversion into deformation energy and the heat resulting from it. The residual kinetic energy of the fragments can be absorbed by the casings.

It is possible to dispense with an additional burst protection arrangement outside the spiral casing.

The spiral casing is configured with an inner cylinder, which at least partially surrounds the casing insert piece, on which inner cylinder, the casing insert piece is attached, to form a hollow space, by means of a fixing arrangement which is flexible in the axial direction. This ensures a high level of protection of the spiral casing itself from impact and an effective "brake" to combat any emergence of fragments from the turbocharger. In a particularly advantageous manner, the rigid fixing arrangement of the compressor casing is configured by means of a firm flange connection of the spiral casing to the bearing casing and the flexible fixing arrangement of the casing insert piece is configured by means of a reduced-shaft screw fixing arrangement in the axial direction through the inner cylinder of the spiral casing.

In a particularly advantageous manner, the bearing casing wall provided for the rigid fixing arrangement of the spiral casing is arranged so that it is drawn downwards in the radial direction to above the outer tip of the outer contour of the compressor impeller, while forming a gap, so that an additional "brake", i.e. security against radial emergence of fragments of the compressor impeller, is provided.

The compressor casing is preferably positioned by means of the outer spiral casing, while forming a joint on the bearing casing, in such a way that the outer spiral casing comprising the deflected duct section, is drawn inward in the radial direction B past the rigid fixing arrangement of the compressor casing on the bearing casing. The rigid fixing arrangement is arranged so that it is located further outward, in the radial direction B, than the joint between the spiral casing and bearing casing. This measure, comprising the particular arrangement of the joint, ensures that the rigid fixing arrangement of the compressor casing on the bearing casing hardly suffers any loads from fragments possibly becoming wedged in the flow duct, by which means, breakage of the compressor casing is excluded to an even greater extent.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The sole FIGURE shows a partial longitudinal section through a turbomachine, according to the invention, in the form of a centrifugal compressor.

DETAILED DESCRIPTION OF THE PRESENTLY PREFERRED EMBODIMENTS

The exhaust gas turbocharger of the type based on the drawing has a shaft 2 supported in its central length region in a bearing casing 1, which carries on its ends protruding beyond the bearing arrangement a turbine wheel (not represented here) and a radial-flow compressor impeller 3 which is diagrammatically represented in the drawing.

The compressor impeller 3 represented has a hub 4 accommodated on and rotating with the shaft 2 driven by the turbine wheel, which hub 4 is equipped at its periphery with radially protruding vanes 5. The outer contour 6 of the hub 4, together with the inner contour 7 of a compressor casing 8, bounds a flow duct 9, which is deflected from the axial direction A into the radial direction B, becomes narrower towards the outside and whose cross section corresponds to the configuration of the vanes 5. The compressor casing 8 is fastened to the bearing casing 1 by means of a rigid fixing arrangement 18. The diameter of the hub 4 and the vanes 5 increases from the flow inlet to the flow outlet so that there is an asymmetrical longitudinal cross section relative to the central transverse plane of the compressor impeller 3 and also, correspondingly, a mass distribution which increases over the length of the compressor impeller 3.

The compressor casing 8 is built up from an outer spiral casing 10 connected to the bearing casing by means of the rigid fixing arrangement 18, which spiral casing 10 comprises the duct section 11 of the flow duct 9 deflected towards the outside into the radial direction B, and an inner casing insert piece 12, which is provided in the radial direction B between the spiral casing 10 and the compressor impeller 3 and whose inner contour 13, together with the outer contour 6 of the hub 4 of the compressor impeller 3, forms the duct section 14 of the flow duct 9 extending essentially in the radial direction A.

The compressor casing 8 is positioned on the bearing casing 1 by means of the outer spiral casing 10 in such a way, while forming a joint 22, that the outer spiral casing 10 comprising the deflected duct section 11 is drawn inward on the rigid fixing arrangement 18 of the compressor casing 8 past the bearing casing 1 in the radial direction B. The rigid fixing arrangement 18 is arranged so that it is located further outward, in the radial direction B, than the joint 22 between the spiral casing 10 and the bearing casing 1. This measure, the special arrangement of the joint 22, ensures that the rigid fixing arrangement 18 of the compressor casing 8 on the bearing casing 1 is scarcely loaded by fragments possibly wedging in the flow duct 9, so that breakage of the compressor casing 8 is excluded to an even greater extent.

In preferred manner, in the exemplary embodiment, the distance between the joint 22 and the shaft 2 is smaller than the distance between the center of area 23, of the maximum cross-sectional area 24 through the deflected duct section 11 in the spiral casing 10, and the shaft 2.

The spiral casing 10 is configured with an inner cylinder 15 at least partially surrounding the casing insert piece 12, on which inner cylinder 15 the casing insert piece 12 is attached to form a hollow space 16 by means of a fixing arrangement 17, which is flexible in the axial direction A. The flexible fixing arrangement 17 of the casing insert 12 is configured so as to be distinctly less secure against fracture than the rigid fixing arrangement 18 of the spiral casing 10 on the bearing casing 1.

The rigid fixing arrangement 18 of the compressor casing 8, or the spiral casing 10, is configured by means of a firm flange connection of the spiral casing 10 to the bearing casing 1 and the flexible fixing arrangement 17 of the casing insert piece 12 is configured by means of a reduced-shaft screw fixing arrangement in the axial direction A through the inner cylinder 15 of the spiral casing 10.

The wall 19 of the bearing casing 1 provided for the rigid fixing arrangement 18 of the spiral casing 10 is arranged so that it is drawn downwards in the radial direction B to above the outer tip 20 of the outer contour 6 of the hub 4 of the compressor impeller 3, while forming a gap 21.

The spiral casing 10 is configured with continually decreasing diameter of the flow duct 9 inwards in the direction of the compressor impeller 3.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A turbomachine comprising a bearing casing, a shaft supported in the bearing casing, a radial-flow compressor impeller comprising a hub fixed to said shaft, said hub having an outer contour, and a compressor casing with a volute shaped flow duct comprising an essentially axially deflecting section and an essentially radially deflecting section, said casing comprising an outer spiral casing which is rigidly fixed to said bearing casing and comprises said radially deflecting section and an inner cylinder, and an inner casing insert piece having an inner contour which together with the outer contour of said hub forms said axially deflecting section, said inner casing insert piece being fixed to said inner cylinder by means of a fixing arrangement and forming a hollow space between said inner cylinder and said insert piece, said fixing arrangement being axially flexible and being less secure against fracture than the rigid fixing of the outer spiral casing to the bearing casing.

2. A turbomachine as in claim 1 wherein said outer spiral casing comprises a flange which is fixed to said bearing casing.

3. A turbomachine as in claim 1 wherein said fixing arrangement comprises a screw received through said inner cylinder, said screw comprising a shaft having a reduced cross-section.

4. A turbomachine as in claim 1 wherein the outer contour of said hub has an outer tip, and said bearing casing comprises a wall to which said spiral outer casing is rigidly fixed, said wall being spaced above said radial tip to form a gap.

5. A turbomachine as in claim 1 wherein said compressor casing is positioned with respect to said bearing casing by means of a joint between said outer spiral casing and said bearing casing, said joint being located radially inward of said rigid fixing of said outer spiral casing to said bearing casing.

6. A turbomachine as in claim 5 wherein said radially deflecting section comprises a maximum cross-section having a maximum radial dimension with a center, said joint being closer to said shaft than said center.

* * * * *